US009733595B1

(12) United States Patent
Tanaka

(10) Patent No.: US 9,733,595 B1
(45) Date of Patent: Aug. 15, 2017

(54) IMAGE FORMING APPARATUS AND TRANSFER DEVICE

(71) Applicant: FUJI XEROX CO., LTD., Tokyo (JP)

(72) Inventor: Daisuke Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/249,780

(22) Filed: Aug. 29, 2016

(30) Foreign Application Priority Data

Mar. 24, 2016 (JP) ..... 2016-059310

(51) Int. Cl.
*G03G 15/20* (2006.01)
*G03G 15/16* (2006.01)

(52) U.S. Cl.
CPC ..... *G03G 15/1615* (2013.01)

(58) Field of Classification Search
USPC ..... 399/107, 110, 121, 297, 302, 303, 399/310–313
See application file for complete search history.

(56) References Cited

U.S. PATENT DOCUMENTS 5,040,028 A * 8/1991 Kamimura ..... G03G 15/1605 399/159
7,428,400 B2 * 9/2008 Iwakura ..... G03G 15/0131 399/302

FOREIGN PATENT DOCUMENTS

JP 7-302002 A 11/1995
JP 2009-15143 A 1/2009

* cited by examiner

*Primary Examiner* — Hoan Tran
(74) *Attorney, Agent, or Firm* — Sughrue Mion, PLLC

(57) ABSTRACT

An image forming apparatus includes an image forming unit including an image carrier; a transfer unit including a transfer belt that is in contact with the image carrier in a transfer region, a transfer roller that presses the transfer belt against the image carrier, and a press-contact member that presses the transfer belt toward the image carrier; and a fixing unit including a pair of fixing members that form a fixing region and fix the toner image onto the sheet by nipping the sheet. The transfer roller and the press-contact member are disposed at positions such that a part of the transfer roller and a part of the press-contact member are on the image carrier side of a tangent plane that is tangent to the image carrier in the transfer region and that passes through an upstream edge of the fixing region in a sheet transport direction.

9 Claims, 1 Drawing Sheet

IMAGE FORMING APPARATUS AND TRANSFER DEVICE

CROSS-REFERENCE TO RELATED APPLICATIONS

This application is based on and claims priority under 35 USC 119 from Japanese Patent Application No. 2016-059310 filed Mar. 24, 2016.

BACKGROUND (i) Technical Field

The present invention relates to an image forming apparatus and a transfer device.

(ii) Related Art

Some existing electrophotographic image forming apparatuses form an image, which is a fixed toner image, by transferring a toner image onto a sheet that is transported to a transfer region and fixing the toner image onto the sheet by using a fixing unit that is disposed downstream of the transfer region in the transport direction of the sheet.

If the sheet, on which the image is to be formed, is long in the transport direction, it may occur that the toner image is still being transferred onto a trailing-end portion of the sheet at a timing at which the leading end of the sheet enters the fixing unit. In this case, vibration due to an impact that occurs when the leading end of the sheet enters the fixing unit may be transmitted to the trailing-end portion of the sheet to which the toner image is being transferred. Then, transfer failure may occur and the image quality may be reduced.

SUMMARY

According to an aspect of the invention, an image forming apparatus includes an image forming unit that includes an image carrier and that forms a toner image on the image carrier; a transfer unit including an endless transfer belt that is in contact with the image carrier in a transfer region in which the transfer belt and the image carrier nip a sheet therebetween when the sheet is transported to the transfer region, a transfer roller that is disposed inside the transfer belt, that presses the transfer belt against the image carrier, and that defines an upstream edge of the transfer region in a sheet transport direction, the transfer roller transferring the toner image on the image carrier onto the sheet by applying an electric field through the transfer belt, and a press-contact member that is disposed inside the transfer belt, that presses the transfer belt upward toward the image carrier, and that defines a downstream edge of the transfer region in the sheet transport direction; and a fixing unit including a pair of fixing members that form a fixing region in which the fixing members are in contact with each other and that fix the toner image onto the sheet, which is transported to the fixing region after the transfer unit has transferred the toner image, by nipping the sheet in the fixing region, the fixing unit forming an image, which is a fixed toner image, on the sheet. The transfer roller and the press-contact member are disposed at positions such that a part of the transfer roller and a part of the press-contact member are on the image carrier side of a tangent plane that is tangent to the image carrier in the transfer region and that passes through an upstream edge of the fixing region in the sheet transport direction.

BRIEF DESCRIPTION OF THE DRAWINGS

An exemplary embodiment of the present invention will be described in detail based on the following figures, wherein.

DETAILED DESCRIPTION

Hereinafter, an exemplary embodiment of the present invention will be described.

Figure 1:
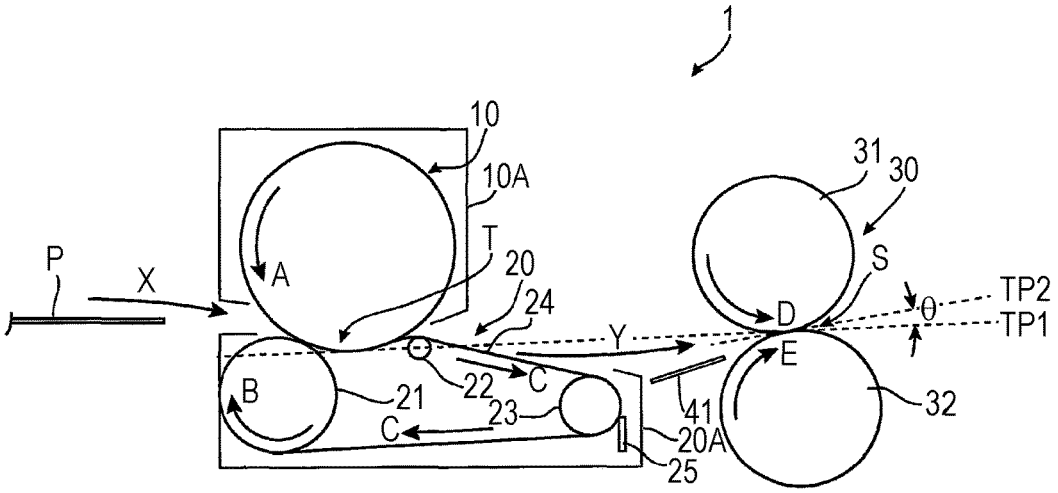
FIG. 1 is a schematic view of an image forming apparatus according to the exemplary embodiment of the present invention.

FIG. 1 is a schematic view of an image forming apparatus 1 according to the exemplary embodiment of the present invention. The image forming apparatus 1 illustrated in FIG. 1 includes a transfer device 20 according to the exemplary embodiment of the present invention.

The image forming apparatus 1 includes a photoconductor drum 10. The photoconductor drum 10 is rotatably supported by a drum support frame 10A and rotates in the direction of arrow A. A charger, an exposure unit, and a developing unit (not shown) are disposed around the photoconductor drum 10. A toner image is formed on the surface of the photoconductor drum 10 through charging, exposure, and development processes; and the toner image is temporarily carried on the photoconductor drum 10.

One of sheets P, which are stacked on a sheet tray (not shown), is transported in the direction of arrow X and passes through a transfer region T between the photoconductor drum 10 and the transfer device 20 (described below in detail). While the sheet P passes through the transfer region T, the toner image on the photoconductor drum 10 is transferred onto the sheet P. The sheet P, to which the toner image has been transferred, is further transported in the direction of arrow Y and fed into a fixing device 30. The fixing device 30 includes a heating roller 31, which rotates in the direction of arrow D, and a pressing roller 32, which rotates in the direction of arrow E. The heating roller 31 and the pressing roller 32 contact each other to form a fixing region S. The sheet P, which has been transported in the direction of arrow Y, enters the fixing region S. While the sheet P passes through the fixing region S, the sheet P is heated and pressed, and the toner image on the sheet P is fixed onto the sheet P. In FIG. 1, the heating roller 31 and the pressing roller 32 each have a simply circular shape. Therefore, the fixing region S is represented by a point in FIG. 1 (or by a straight line extending in a direction perpendicular to the plane of FIG. 1, when the longitudinal direction of the heating roller 31 and the pressing roller 32 (the direction perpendicular to the plane of FIG. 1) is taken into consideration). In reality, however, the fixing region S has a width in the sheet transport direction, because the rollers 31 and 32 are slightly deformed by being pressed.

After the toner image has been transferred in the transfer region T, residual toner remains on the photoconductor drum 10. A cleaner (not shown) removes the residual toner from the photoconductor drum 10.

The transfer device 20 includes a transfer roller 21; a press-contact roller 22; a peel-off roller 23; and a transfer belt 24, which is an endless belt looped over these rollers. The transfer roller 21, the press-contact roller 22, and the peel-off roller 23 are rotatably supported by a transfer-unit support frame 20A.

The transfer roller 21 is an elastic roller whose roller surface is elastically deformable. The transfer roller 21 rotates in the direction of arrow B and drives the transfer belt 24. The transfer belt 24 is driven by the transfer roller 21 and rotates in the direction of arrow C. The transfer roller 21 is located upstream of the rotation axis of the photoconductor drum 10 in the sheet transport direction and presses the transfer belt 24 against the photoconductor drum 10 from the inside of the transfer belt 24. The transfer roller 21 defines an upstream edge of the transfer region T, in which the photoconductor drum 10 and the transfer belt 24 are in contact to each other.

The press-contact roller 22 is located downstream of the rotation axis of the photoconductor drum 10 in the sheet transport direction and presses the transfer belt 24 upward toward the photoconductor drum 10 from the inside of the transfer belt 24. The press-contact roller 22 defines a downstream edge of the transfer region T. The press-contact roller 22 corresponds to an example of a press-contact member in the present invention.

The diameter of the peel-off roller 23 is smaller than that of the transfer roller 21. The peel-off roller 23 sharply changes the direction in which the transfer belt 24 moves, so that the leading end of the sheet P on the transfer belt 24 is peeled off the transfer belt 24. The sheet P, which has been peeled off the transfer belt 24, is guided by a guide member 41 and moves in the direction of arrow Y. Then, as described above, while the sheet P passes through the fixing region S of the fixing device 30, a toner image is fixed onto the sheet P. Thus, an image, which is a fixed toner image, is formed on the sheet P. The sheet P, on which the image has been formed, is output onto a sheet output tray (not shown).

The transfer device 20 further includes a cleaner 25. The cleaner 25 removes toner and other substances adhering to the transfer belt 24 from the transfer belt 24.

The transfer roller 21 is connected to a power supply (not shown) that applies a transfer voltage to the transfer roller 21. Due to the effect of the transfer bias, a toner image on the photoconductor drum 10 is transferred onto the sheet P while the sheet P passes through the transfer region T.

A tangent plane TP1 is defined as follows. The tangent plane TP1, which is represented by a straight line in the cross section shown in FIG. 1, is a plane that includes the straight line and that is perpendicular to the plane of FIG. 1. The tangent plane TP1 is defined as a plane that is in contact with the surface of the photoconductor drum 10 in the transfer region T and that passes through an upstream edge of the fixing region S in the sheet transport direction. (In FIG. 1, the upstream edge is illustrated as a contact point between the heating roller 31 and the pressing roller 32). In the present exemplary embodiment, the transfer roller 21 and the press-contact roller 22 are disposed so that a part of the transfer roller 21 and a part of the press-contact roller 22 are on the photoconductor drum 10 side of the tangent plane TP1.

Another tangent plane TP2 is defined as follows. In FIG. 1, the heating roller 31 and the pressing roller 32 are illustrated as circles that are in point-contact with each other (when the longitudinal direction is taken into consideration, as hollow or solid cylinders that are in line-contact with each other). The tangent plane TP2 is defined as a plane that is tangent to both of the heating roller 31 and the pressing roller 32 when the heating roller 31 and the pressing roller 32 are illustrated as shown in FIG. 1.

The heating roller 31 and the pressing roller 32 are not arranged along a vertical line but along a line that is slightly inclined. Therefore, the tangent plane TP2 is also slightly inclined so as to extend downward toward the upstream side in the sheet transport direction (the left side in FIG. 1) and so as to extend upward toward the downstream side in the sheet transport direction (the right side in FIG. 1). As described above, in reality, the fixing region S has a width in the sheet transport direction, and the width extends in a direction along the tangent plane TP2.

The tangent plane TP2 is inclined upward toward the right side by an angle θ, compared with the tangent plane TP1. Therefore, when a front side of the tangent plane TP1 is defined as a side facing the photoconductor drum 10, the fixing region S is inclined so as to be located on the front side of the tangent plane TP1 while the upstream edge of the fixing region S in the sheet transport direction is in contact with the tangent plane 1.

Figure 2:
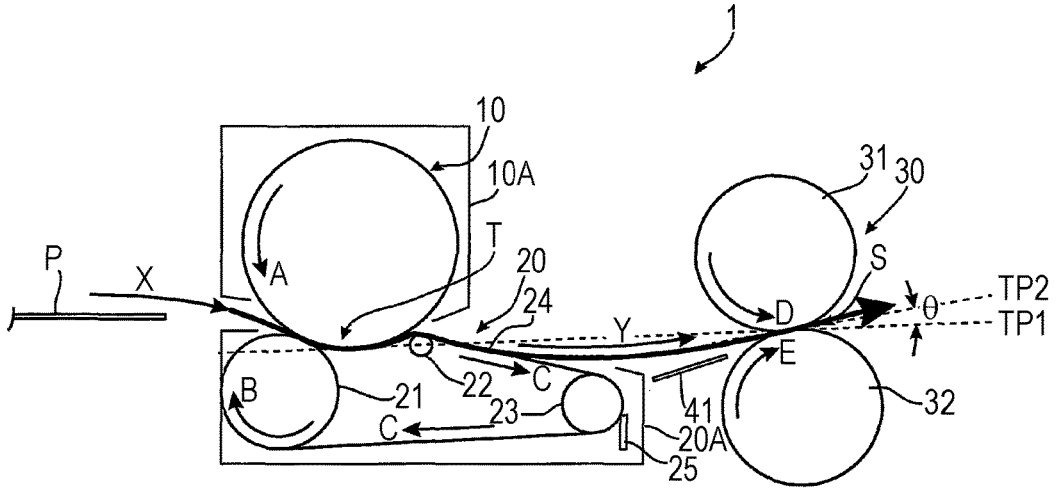
FIG. 2 is a schematic view illustrating a movement path of a sheet in addition to the image forming apparatus shown in FIG. 1.

FIG. 2 is a schematic view in which a movement path of a sheet P is illustrated in addition to the image forming apparatus 1 shown in FIG. 1.

Referring to FIG. 2, a case of forming an image on the sheet P having a length such that, at a timing at which the leading end of the sheet P enters the transfer region T, the trailing end of the sheet P still remains in the transfer region T will be described. In the image forming apparatus 1, the distance between the transfer region T and the fixing region S is about 230 mm. If the size of the sheet P is not larger than A4, the leading end of the sheet P enters the fixing region S after the trailing end of the sheet P has exited the transfer region. However, if an A3-sized sheet is transported in its longitudinal direction, the trailing end of the sheet still remains in the transfer region T at a timing at which the leading end of the sheet enters the fixing region S. In this case, a toner image is still being transferred at a timing at which the leading end of the sheet enters the fixing region S. Therefore, vibration due to an impact that occurs when the leading end of the sheet enters the fixing region S may be transmitted and vibrate the transfer belt 24 and the transfer roller 21, and a decrease of image quality due to transfer failure may occur.

In the transfer device 20 according to the present exemplary embodiment, the press-contact roller 22 is disposed on the fixing device 30 side of the transfer region T. A part of the press-contact roller 22 is located on the photoconductor drum 10 side of the tangent plane TP1 and presses the transfer belt 24 against the photoconductor drum 10. Therefore, even when vibration that occurs when the leading end of the sheet enters the fixing region S is transmitted through the sheet P, the press-contact roller 22 blocks the transmission of the vibration, and therefore the vibration is not transmitted further upstream, that is, to the transfer region T. Thus, even when the leading end of the sheet P reaches the fixing region S and causes an impact, image transfer is continued to be performed stably, and therefore a decrease of image quality due to transfer failure is prevented.

In the present exemplary embodiment, the tangent plane TP2, that is, the fixing region S extending along the tangent plane TP2 is more steeply inclined upward toward the right side in FIG. 2 than the tangent plane TP1 is. Therefore, the sheet P is likely to become warped so as to be downwardly convex as illustrated in FIG. 2, compared with a case where the tangent plane TP2 is the same as the tangent plane TP1, that is, the fixing region S is in the tangent plane TP1, or a case where the tangent plane TP2, that is, the fixing region S is less steeply inclined upward toward the right side in FIG. 2 than the tangent plane TP1 is. When the sheet P becomes warped in this way, due to warping, vibration that occurs when he leading end of the sheet P enters the fixing region S is attenuated while the vibration is transmitted through the sheet P. Accordingly, with the present exemplary embodiment, because the fixing region S is inclined upward toward the right side, vibration that occurs due to an impact that occurs when the leading end of the sheet enters the fixing region S is less likely to be transmitted to the transfer region T, and image transfer is performed more reliably without being hindered by the impact.

In the embodiment described above, the press-contact roller 22 is used as an example of a press-contact member in the present invention. However, instead of a roller, a fixed contact member, over which the back surface of the transfer belt 24 slides, may be used as a press-contact member in the present invention.

In the exemplary embodiment described above, the photoconductor drum 10 is used as an example of an image carrier in the present invention. However, the present invention is also applicable to a case where an intermediate transfer member, to which a toner image is first-transferred from a photoconductor drum and from which the toner image is second-transferred onto a sheet, is used as an example of an image carrier.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that includes an image carrier and that forms a toner image on the image carrier;

a transfer unit including an endless transfer belt that is in contact with the image carrier in a transfer region in which the transfer belt and the image carrier nip a sheet therebetween when the sheet is transported to the transfer region, a transfer roller that is disposed inside the transfer belt, that presses the transfer belt against the image carrier, and that defines an upstream edge of the transfer region in a sheet transport direction, the transfer roller transferring the toner image on the image carrier onto the sheet by applying an electric field through the transfer belt, and a press-contact member that is disposed inside the transfer belt, that presses the transfer belt upward toward the image carrier, and that defines a downstream edge of the transfer region in the sheet transport direction; and a fixing unit including a pair of fixing members that form a fixing region in which the fixing members are in contact with each other and that fix the toner image onto the sheet, which is transported to the fixing region after the transfer unit has transferred the toner image, by nipping the sheet in the fixing region, the fixing unit forming an image, which is a fixed toner image, on the sheet, wherein the transfer roller and the press-contact member are disposed at positions such that a part of the transfer roller and a part of the press-contact member are on the image carrier side of a tangent plane that is tangent to the image carrier in the transfer region and that passes through an upstream edge of the fixing region in the sheet transport direction.

2. The image forming apparatus according to claim 1, wherein, when a front side of the tangent plane is defined as a side facing the image carrier, the fixing region is inclined relative to the tangent plane so that an upstream portion and a downstream portion of a plane that passes through the fixing region and extends along the fixing region are respectively located on a back side and on the front side of the tangent plane, the upstream portion and the downstream portion being respectively located upstream and downstream of the fixing region in the sheet transport direction.

3. The image forming apparatus according to claim 2, wherein the transfer roller is a roller whose surface is elastically deformable by being pressed and that drives the transfer belt.

4. The image forming apparatus according to claim 3, wherein the image carrier is a photoconductor on which an electrostatic latent image is formed and developed into a toner image by using a toner and that carries the toner image.

5. The image forming apparatus according to claim 2, wherein the image carrier is a photoconductor on which an electrostatic latent image is formed and developed into a toner image by using a toner and that carries the toner image.

6. The image forming apparatus according to claim 1, wherein the transfer roller is a roller whose surface is elastically deformable by being pressed and that drives the transfer belt.

7. The image forming apparatus according to claim 6, wherein the image carrier is a photoconductor on which an electrostatic latent image is formed and developed into a toner image by using a toner and that carries the toner image.

8. The image forming apparatus according to claim 1, wherein the image carrier is a photoconductor on which an electrostatic latent image is formed and developed into a toner image by using a toner and that carries the toner image.

9. A transfer device comprising:

an endless transfer belt that is in contact with an image carrier, which carries a toner image formed thereon, in a transfer region in which the transfer belt and the image carrier nip a sheet therebetween when the sheet is transported to the transfer region;

a transfer roller that is disposed inside the transfer belt, that presses the transfer belt against the image carrier, and that defines an upstream edge of the transfer region in a sheet transport direction, the transfer roller transferring the toner image on the image carrier onto the sheet by applying an electric field through the transfer belt; and a press-contact member that is disposed inside the transfer belt, that presses the transfer belt upward toward the image carrier, and that defines a downstream edge of the transfer region in the sheet transport direction, wherein the transfer device feeds the sheet toward a pair of fixing members that form a fixing region in which the fixing members are in contact with each other and that fix the toner image onto the sheet, which is transported to the fixing region after the toner image has been transferred thereto, by nipping the sheet in the fixing region, and wherein the transfer roller and the press-contact member are disposed at positions such that a part of the transfer roller and a part of the press-contact member are on the image carrier side of a tangent plane that is tangent to the image carrier in the transfer region and that passes through an upstream edge of the fixing region in the sheet transport direction.

* * * * *